United States Patent [19]

Cochran et al.

[11] 4,012,003

[45] Mar. 15, 1977

[54] FEEDING AND PROPELLING SYSTEM FOR THE TAPE IN A SEED-TAPE MANUFACTURING MACHINE

[75] Inventors: Troy L. Cochran; Melvin D. Kirkpatrick, both of Salinas; Robert J. Walder, Soquel, all of Calif.

[73] Assignee: Union Carbide Corporation, New York, N.Y.

[22] Filed: Nov. 19, 1973

[21] Appl. No.: 416,761

Related U.S. Application Data

[63] Continuation of Ser. No. 208,281, Dec. 15, 1971, abandoned.

[52] U.S. Cl. ..... 242/55; 242/75.51; 242/76

[51] Int. Cl.[2] ..... B65H 17/12; B65H 25/22; B65H 27/00

[58] Field of Search ..... 242/55, 65, 66, 75.51, 242/76, 157 R, 189, 190, 45, 78.7

[56] References Cited

UNITED STATES PATENTS

| | | | |
|---|---|---|---|
| 3,555,774 | 1/1971 | Craig | 242/67.2 X |
| 3,565,366 | 2/1971 | Campbell | 242/190 |

*Primary Examiner*—Stanley N. Gilreath
*Assistant Examiner*—John M. Jillions
*Attorney, Agent, or Firm*—Owen, Wickersham & Erickson

[57] ABSTRACT

A seed-tape manufacturing machine having a main drive for pulling the tape past a seed-dispenser and an auxiliary drive for positively unwinding a drum-like cylinder to tape through peripheral contact means that engage the drum's periphery. The auxiliary drive comprises a variable speed DC motor, with a potentiometer controlling its speed. The resistance of the potentiometer is changed by rotation of a shaft which carries a pinion gear in mesh with a larger gear on another shaft, and this other shaft is supported by a beam that is pivotally mounted on the axis of that shaft. At an outboard end of the beam is a movable portion of a guide-and-tension means via which the unwinding tape is fed to the main tape driving means. When the speed of unwinding and the speed of the main drive differ somewhat, the beam is swung up or down about its pivot, in order to maintain a substantially constant tape tension at the guide-and-tension means. This results in changing the resistance of the potentiometer and thereby the voltage to the DC motor, and therefore in varying the motor's speed in such a way as to compensate for the change and to tend to restore the two drives to equilibrium.

8 Claims, 4 Drawing Figures

FEEDING AND PROPELLING SYSTEM FOR THE TAPE IN A SEED-TAPE MANUFACTURING MACHINE

This is a continuation of application Ser. No. 208,281 filed Dec. 15, 1971, now abandoned.

BACKGROUND OF THE INVENTION

This invention relates to improvements in a feeding, propelling and tensioning system for tape in a seed-tape manufacturing machine. It may be considered as an improvement on U.S. Pat. No. 3,555,774.

In that patent, as in the present invention, the tape is propelled by a pair of rollers beyond the seed-dispensing station, between which the tape passes. One of these rollers is driven by main drive means while the other roller is an idler urged towards the driven roller. The tape supply is a cylindrical drum that is supported partly by driven peripheral contact means for unwinding the tape from the drum. In this U.S. Pat. No. 3,555,774, an auxiliary drive means acts through a differential to vary the speed of the peripheral contact means, which is driven principally by the main drive means. The differential superimposes a positive or negative speed on the basic speed, as determined by the auxiliary drive means. Control means responsive to the difference in speed at which the tape unwinds relative to the speed of the tape propulsion by the drive rollers, acts to change the speed of the auxiliary drive means and thereby the speed at which the tape unwinds. The control means involves two parallel shafts spaced apart from each other, with the tape passing in tension between them. A pivoted beam supports one of these shafts for movements toward and away from the other shaft according to the length of tape between them by swinging the beam upon its pivot. A cam supported by the beam engages, at times, a plurality of micro-switches, one of which acts to accelerate the auxiliary drive means when the length of tape between the shafts is short enough to tilt the beam to a predetermined amount in one direction, and another microswitch acts to decelerate the auxiliary drive means when the length of tape between the shafts is long enough to cause the beam to tilt a predetermined amount in the opposite direction.

While this device of U.S. Pat. No. 3,555,774 can and does achieve satisfactory results, it has several disadvantages. For one thing, it is expensive to manufacture, because the differential assembly itself is expensive and the arrangement for superimposing the differential's action on the main drive, as applied to the peripheral contact means, calls for a complex and expensive arrangement.

Another difficulty with the embodiment shown in U.S. Pat. No. 3,555,774 is that it tended to induce vibration, due to the use of on/off devices and various mechanical transmission arrangements. Hence, the machine tended to be shaken and thereby its accuracy was impaired to some extent. The action could not be made as smooth as was desired, even though it was used at rapid speeds, and it was more satisfactory at the slower speeds and more accurate when there was less vibration.

The device of U.S. Pat. No. 3,555,774 was at a disadvantage at rapid speeds, when it tended to be inaccurate. It also had the disadvantage that the motor for the main drive was required to do several other things besides operating the main drive and therefore had to be relatively large and expensive, and the transmission arrangements themselves were a requisite of this type of device.

SUMMARY OF THE INVENTION

In the present invention the main drive motor continues to drive the tape past the seed dispenser, but there is a completely separate and unconnected drive for the peripheral contact means that unwinds the tape from the drum-like cylinder. The auxiliary means for this purpose comprises a DC motor of variable speed, in conjunction with a potentiometer, which, by controlling the amount of voltage applied to the DC motor, controls its speed. The guide-and-tension means again includes a shaft mounted on a pivoted beam, but in this case no microswitches are used for this purpose, although there may be a safety microswitch for a different purpose and corresponding to a safety microswitch also present in the earlier patent. The regulation of the position of the potentiometer, and therefore the speed of the DC motor, is achieved by having the beam rotate a shaft at the beam's pivot point, a large gear being mounted on the shaft. A smaller pinion gear is mounted on a second shaft parallel to that shaft, and the second shaft carries the resistance-changing rheostat device for the potentiometer. Thus, the beam which maintains the tension on the tape swings according to the difference in speed between the main drive and the auxiliary drive, and as it swings it acts through a reduction gear on the potentiometer to vary the speed of the DC motor in a way that tends to bring the beam back to center. In other words, if the motor is moving too slowly, the swinging of the beam causes it to speed up somewhat; if the motor is too fast, the swinging of the beam causes it to slow down somewhat.

The action of the present device is very smooth. It is not so jerky as when microswitches are used as positive off/on members. In this instance, the transition can effect a very slight change of the motor speed or a larger change of the motor speed, and the operation takes place without substantial vibration. Also there is no need to have any complex interconnection and transmission arrangement for superimposing a change on the main drive, because the main drive is left completely independent to continue its primary operation.

Other objects and advantages of the invention will appear from the following description of a preferred embodiment.

DESCRIPTION OF A PREFERRED EMBODIMENT

Figure 1:
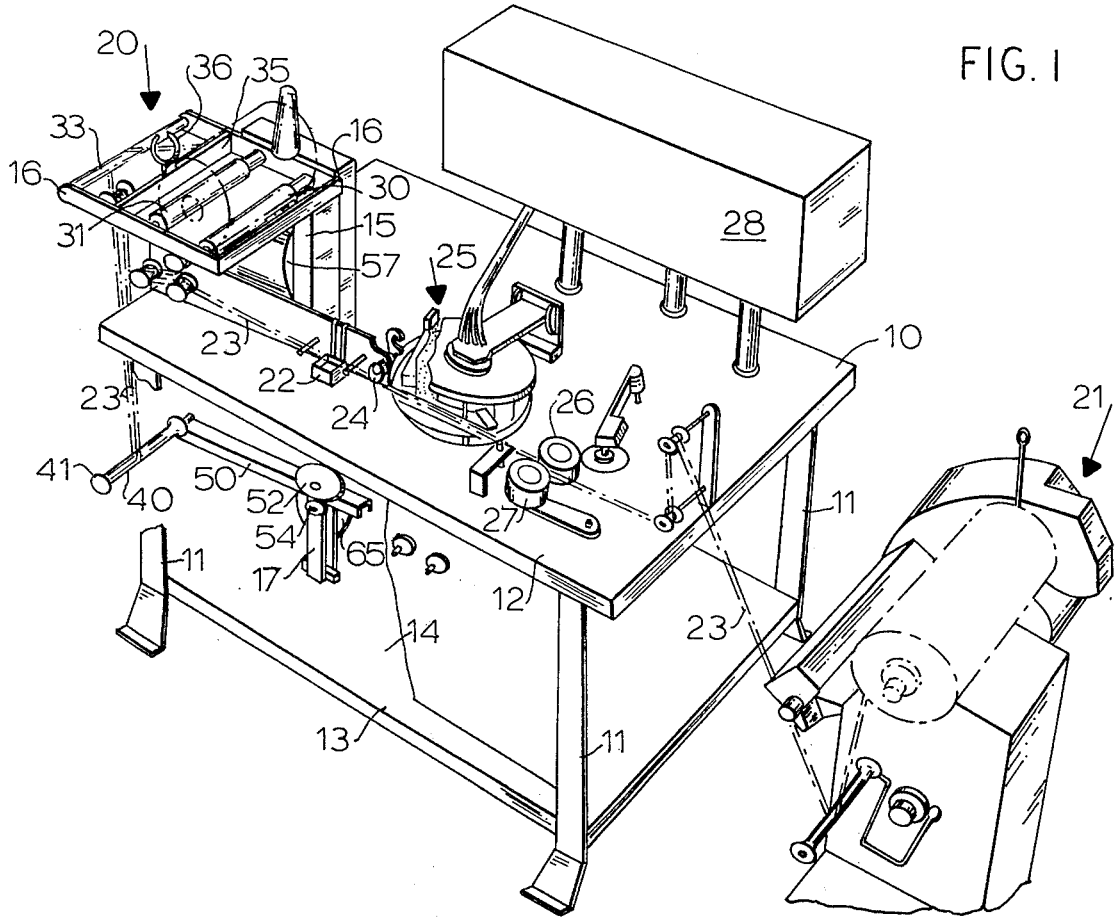
FIG. 1 is a view in perspective of a seed-tape manufacturing machine embodying the principles of this invention, partly broken away to show parts otherwise obscured.

A main support table 10 has legs 11, a top 12 on which most of the operations take place, a lower deck 13 and a front panel 14. Several vertical brackets 15 on top of the table top 12 support a horizontal frame 16, and a support bracket 17 extends up from the deck 13.

A tape supply assembly 20 at one end of the table 10 includes the frame 16, while a tape take-up assembly 21 is shown as a separate unit, located near the other end of the table 10. Between these two assemblies 20 and 21 is a moistening station 22 where a strip 23 of the tape is moistened to enable later sealing, a troughing station 24 at which the tape 23 is formed into a trough shape to receive seeds, a seed-dispensing station 25, and a pair of closing rollers 26 and 27, which act to pull the tape 23 through the machine, serving as the main drive therefor, and to close the moistened sector of the tape 23 against other portions of the tape so as to seal the seed inside where it will be encapsulated substantially hermetically and protected from the effects of the atmosphere. The moistening station 22, troughing station 24, seed-dispensing station 25, and a control panel 28 associated with them, form no particular part of the present invention except as they are in combination with other members and cooperate with them. The seed, which is picked up either one seed at a time or one group of seeds at a time, is so dispensed into the troughed tape 23 that the desired spacing is achieved by the motion of the tape 23 relative to the speed of the seed-dispensing apparatus and the distance apart of the seed dispensing nozzles.

The tape supply assembly 20 includes the bracket 15 and the frame 16, which supports for rotation a drive shaft 30 and an idler shaft 31 on which a cylindrical drum 32 of the tape 23 rides. At the far end, the frame 16 carries an idling guide and tensioning roller 33. The roll or cylinder 32 of tape 23 rests loosely on top of the shafts 30 and 31, and several miles of this thin tape 23, which may be a polyethylene oxide tape, can be supported on a core 34 which is wound so that the tape 23 is dispersed substantially evenly along the full width of the core 34, ending up in what is substantially a cylinder 32 of tape 23. The shafts 30 and 31 may be substantially alike, having reduced ends that are journaled in the frame 16 and an enlarged main body that supports the tape cylinder 32 peripherally, the tape cylinder 32 being placed across the two shafts 30 and 31, bridging them and resting on them. Thus, rotation of the driven shaft 30 at a constant speed rotates the cylinder 32 at a constant peripheral speed to drive the periphery of the tape cylinder 32, so that the tape 23 is unwound at substantially the peripheral velocity of the drive roller 30. This peripheral velocity is carefully controlled, as will be seen below.

A cross-bar 35 carried by the frame 16 supports a circular guide 36, which is open at the top to enable the tape 23 to be inserted through it, and this circular guide 36 is used to guide the tape 23 from any part of the roll 32 to a central position on the idling guide and tensioning roller 33 at substantially a constant location. The purpose of this is to make it possible to handle the tape properly even when the roll or cylinder 32 has not been quite properly made and is therefore somewhat out of balance, being larger at one end or at both of its ends than in the middle, or for some other reason is not quite properly wound. In those instances trouble has occured in the past from improper unwinding and guiding, and it was then difficult to align the tape 23 properly at other locations.

After the tape 23 passes through the circular guide 36, it makes its rolling contact with the guide and tensioning roller 33, which is set in ball bearings at the far end of the frame 16 and extends the full width of the frame 16, guiding the unwinding tape 23 around what is substantially a right angle. With the aid of the guide 36 the tape is controlled to a center position on this roller 33. The guide 36 may be withdrawn and not used when the cylinder 32 is perfect, but there is no disadvantage in leaving it there at all times.

From the roller 33 the tape 23 goes down generally vertically to and is guided around a tensioning and guide shaft 40 having enlarged ends 41 with smoothly curved flanges to prevent the tape 23 from accidentally riding off the shaft 40. From the shaft 40 the tape 23 moves up to a tape guide roller 42 and from there is guided by rollers 43, 44, and 45 and on to the seed dispensing station 25. Preferably, a guide member 46 is also located between the roller 33 and the shaft 40, to come into contact with the tape 23 on both its descending path and its ascending path and to improve its alignment with the roller 42. This member 46 may comprise a J-shaped member with a long frame-supported shank 47, a U-turn 48 and a return portion 49, the portions 47 and 49 being horizontal. On both paths, the tape 23 goes on one side of the portion 47 and on the other side of the portion 49.

The shaft 40 is supported at one end of a pivoted beam 50, which is secured to a shaft 51, and the shaft 51 is journaled for rotation in the stationary bracket 17. On the shaft 51 is a pinion gear 52, so that as the beam 50 swings around its axis — which is the axis of the shaft 51 — the pinion gear 52 is rotated a corresponding amount. The beam 50 changes its position due to a difference in the speed between the tape unwinding shaft 30 and the main drive roller 26.

The bracket 17 also supports a shaft 53 parallel to the pivot shaft 51, and on that shaft 53 is a smaller pinion gear 54 in engagement with the gear 52. Hence, the shaft 53 is rotated considerably more than the shaft 51, due to this reduction gear arrangement. The shaft 53 carries the resistance tap of a potentiometer 55.

The potentiometer 55 is connected by suitable leads 56 to an auxiliary DC motor 57 which drives the shaft 58 and sprocket 59 that drives a chain 60. A sprocket 61 on the shaft 30 engages the chain 60. Thus the motor 57 provides the drive for the tape unwinding shaft 30. The potentiometer 55, of course, changes resistance as the shaft 53 turns, due to swinging of the beam 50. Thereby, the potentiometer 55 changes the voltage applied to the DC motor 57, and as a result controls its speed, so that every time the beam 50 shifts its position, it rotates its pivot shaft 51 and, through the gears 52 and 54, causes a rotation of the shaft 53 carrying the potentiometer 55's variable tap, thereby causing a change in the speed of the motor 57. The arrangement is set up so that when the beam 50 rises, the potentiometer 55 lowers the resistance and increases the voltage and therefore the speed of the motor 57, whereas when the beam 50 dips, the speed of the motor 57 is lowered by the potentiometer 55. The beam 50 dips when the motor 57 is running at a speed too fast for the drive rollers 26 and 27 and their motor 62, and the beam 50 rises when the speed of the motor 57 is slow compared to that of the motor 62. Thus, very smooth operation is obtained without having to have any effect on or dependence upon the main drive motor 62. The auxiliary motor 57 is made to be very accurate in its speeds, and is readily adjusted to the general requirements of the main drive motor 62.

Figure 2:
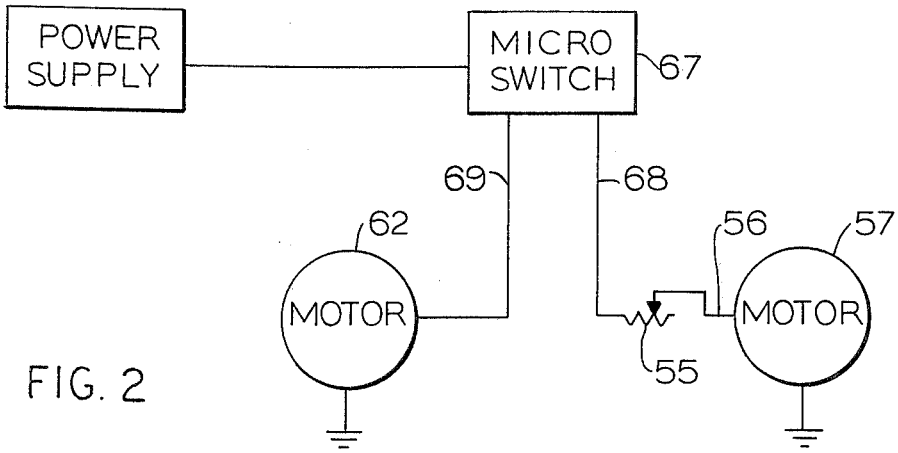
FIG. 2 is a simplified electrical diagram of the motor drives for the machine of FIG. 1.
Figure 3:
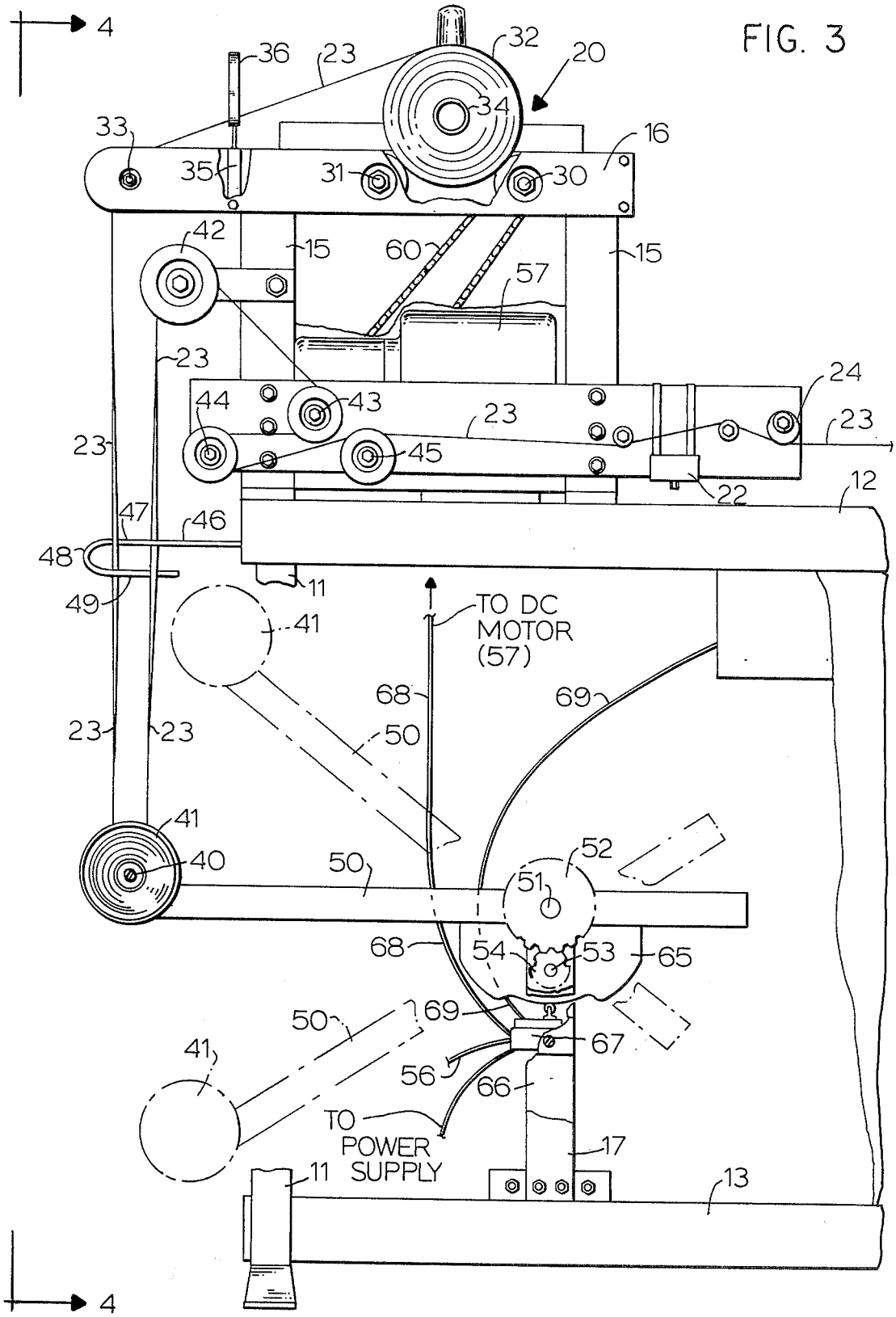
FIG. 3 is a fragmentary view in front elevation of the tape-unwinding and tape-trimming end of the machine of FIG. 1, partly broken away to show parts otherwise obscured. Alternative positions of the beam are shown in broken lines.
Figure 4:
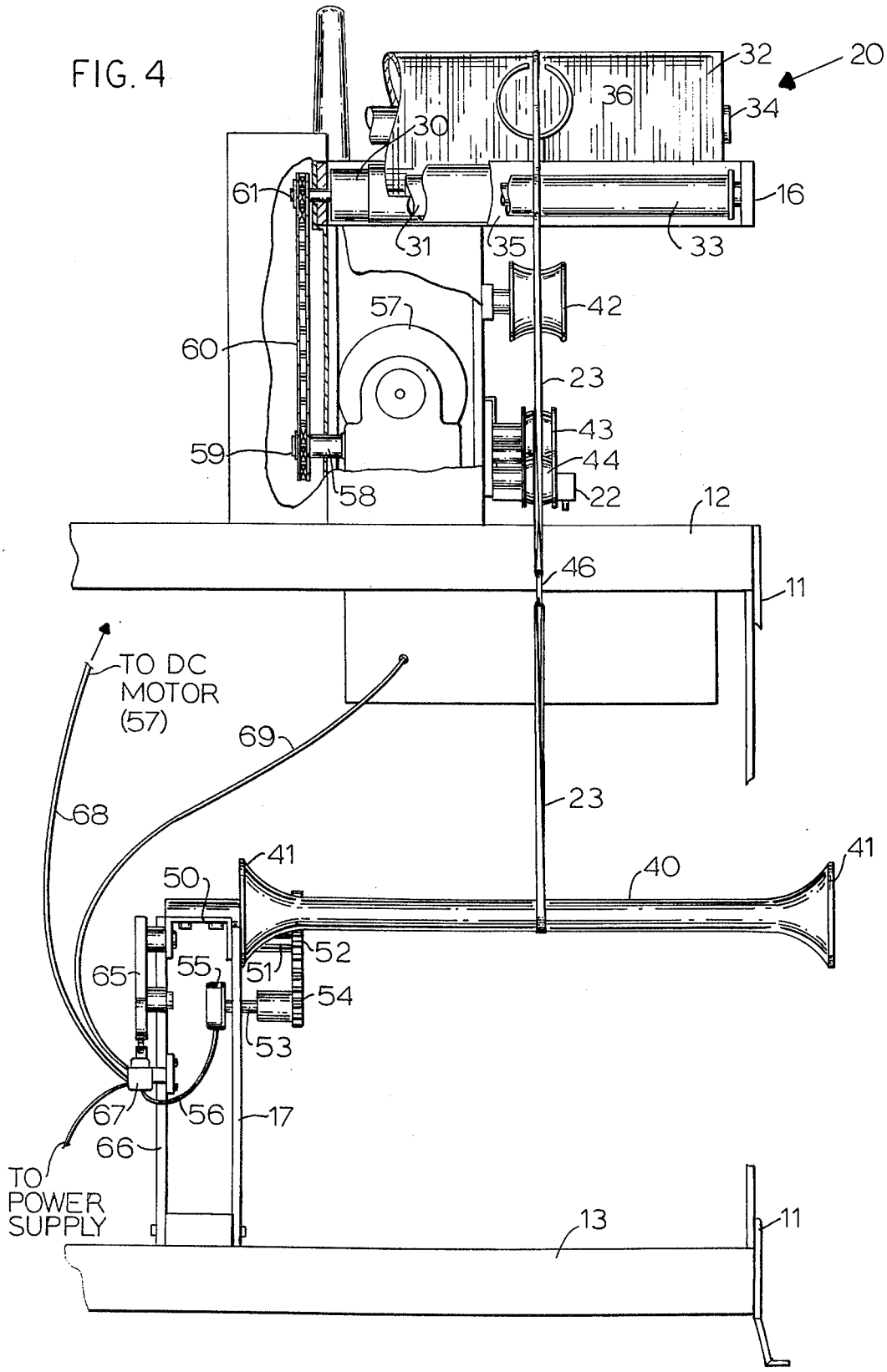
FIG. 4 is a view in end elevation of the machine, looking at FIG. 3 from the left, partly broken away and shown in section.

As a safety precaution the beam 50 is also provided with a cam portion 65, and a bracket 66 supports a microswitch 67, which is engaged at either end of the cam portion 65. Engagement indicates that the tape 23 is being unwound from the cylinder 32 either so much faster or so much slower than the main drive that the entire machine should be stopped, and this microswitch 67 does act through leads 68 and 69 to stop both motors 57 and 62, the entire machine, at that point. (See FIG. 2) Thus, when the beam 50 is sharply tilted in either direction the effect will be to stop the entire machine, including all the drive motors.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In a seed-tape manufacturing machine having a main tape driving means for driving tape past a seed-dispensing means, peripheral contact means for engaging the periphery of a drum-like cylinder of tape for positively unwinding it, the combination therewith of:

guide-and-tension means for guiding the unwound tape under tension to said main tape driving means, said guide-and-tension means including a first shaft adjacent to said peripheral contact means, over which said tape passes, and a second shaft over which said tape passes in tension between said first shaft and said main tape driving means, a pivoted beam supporting said second shaft for movement toward and away from said first shaft according to the length of said tape, by swinging said beam upon its pivot, said guide-and-tension means maintaining a substantially constant tape tension even when the relative speeds of tape unwinding and the speed of tape drive are different, a first centering tape guide secured in a stationary laterally central position between said peripheral contact means and said first shaft, a DC motor driving said peripheral contact means completely independently of said main drive means, a potentiometer controlling the speed of said DC motor, varying means for changing the resistance of said potentiometer so as to vary the speed of said DC motor, transmitting means connecting said beam to said varying means, so that a change in position in said second shaft automatically causes a change in the speed of said DC motor that tends to drive the peripheral contact means at the same speed as the main tape driving means is driving the tape.

2. The machine of claim 1 wherein said first centering tape guide comprises a circular frame open at the top.

3. The machine of claim 1 having a second centering tape guide secured in a stationary position between said first and second shafts and in contact with said tape both on its way from said first shaft to said second shaft and on its path away from said second shaft.

4. The machine of claim 3 wherein said second centering tape guide has a J-shaped member with a horizontal shank, a 180° turn, and a horizontal end member, with the tape on both engagements therewith engaging one side of said shank and the other side of said end member.

5. In a seed-tape manufacturing machine having a main tape driving means for driving tape past a seed-dispensing means, secondary driving means for positively unwinding a drum-like cylinder of tape, the combination therewith of:

guide-and-tension means for guiding the unwound tape under tension from said secondary driving means to said main tape driving means, said guide-and-tension means including a first shaft adjacent to said secondary driving means, over which said tape passes, and a second shaft over which said tape passes in tension between said first shaft and said main tape driving means, a pivoted beam supporting said second shaft for movement toward and away from said first shaft according to the length of said tape, by swinging said beam upon its pivot, said guide-and-tension means maintaining a substantially constant tape tension even when the relative speeds of tape unwinding and the speed of tape drive are different, a first centering tape guide secured in a stationary laterally central position between said secondary driving means and said first shaft, a DC motor driving said secondary driving means completely independently of said main drive means, circuit means controlling the speed of said DC motor, varying means for changing the resistance of said circuit means so as to vary the speed of said DC motor, transmitting means connecting said beam to said varying means, so that a change in position in said second shaft automatically causes a change in the speed of said DC motor that tends to drive the secondary driving means at the same speed as the main tape driving means is driving the tape.

6. The machine of claim 5 wherein said first centering tape guide comprises a circular frame open at the top.

7. The machine of claim 5 having a second centering tape guide secured in a stationary position between said first and second shafts and in contact with said tape both on its way from said first shaft to said second shaft and on its path away from said second shaft.

8. The machine of claim 7 wherein said second centering tape guide has a J-shaped member with an horizontal shank, an 180° turn, and an horizontal end member, with the tape on both engagements therewith engaging one side of said shank and the other side of said end member.

* * * * *